US012790048B2

(12) United States Patent
Fesalvo

(10) Patent No.: US 12,790,048 B2
(45) **Date of Patent: *Nov. 10, 2026**

(54) METHODS FOR PACKAGING CANNABIS

(71) Applicant: Giselle Fesalvo, Highwood, IL (US)

(72) Inventor: Giselle Fesalvo, Highwood, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/217,776

(22) Filed: May 23, 2025

(65) Prior Publication Data

US 2025/0282507 A1 Sep. 11, 2025

Related U.S. Application Data

(63) Continuation of application No. 18/336,729, filed on Jun. 16, 2023, now Pat. No. 12,325,549.

(51) Int. Cl.

| | |
|---|---|
| ***B65B 11/52*** | (2006.01) |
| ***B65B 1/24*** | (2006.01) |
| ***B65B 7/16*** | (2006.01) |
| ***B65B 35/30*** | (2006.01) |

(52) U.S. Cl.

CPC ..... *B65B 7/162* (2013.01); *B65B 1/24* (2013.01); *B65B 11/52* (2013.01); *B65B 35/30* (2013.01)

(58) Field of Classification Search

USPC ..... 53/427

See application file for complete search history.

(56) References Cited

U.S. PATENT DOCUMENTS

| | | | | |
|---|---|---|---|---|
| 3,948,014 | A | 4/1976 | Wolfelsperger | |
| 5,649,412 | A | 7/1997 | Binacchi | |
| 6,073,422 | A * | 6/2000 | Massey | B65B 43/54 53/471 |
| 10,604,292 | B1 | 3/2020 | Dodson et al. | |
| 11,116,249 | B2 | 9/2021 | Hemphill et al. | |
| 11,369,134 | B2 | 6/2022 | Lockwood | |
| 2004/0011693 | A1 * | 1/2004 | Prenger | B65D 73/0092 53/438 |
| 2004/0118087 | A1 | 6/2004 | Slaboden | |

(Continued)

FOREIGN PATENT DOCUMENTS

| | | |
|---|---|---|
| EP | 2 725 932 B1 | 8/2018 |
| TW | 202205979 A | 2/2022 |

(Continued)

OTHER PUBLICATIONS

Futurola, "Knockbox 3/50 Pre-Roll Filling Machine With Standard Filling Kit," MarijuanaPackaging.com, retrieved from https://marijuanapackaging.com/collections/pre-rolled-cone-filling-machines/products/pre-roll-filling-machine-futurola-knockbox-3-50-with-standard-filling-kit-fill-50-pre-rolled-cones-in-2-minutes on Jan. 9, 2023, 9 pages (n.d.).

(Continued)

*Primary Examiner* — Chinyere J Rushing-Tucker

(74) *Attorney, Agent, or Firm* — Foley & Lardner LLP

(57) ABSTRACT

A method for packaging *cannabis* includes placing a first portion of ground *cannabis* into a first capsule mold of a tray. The method also includes pressing the first portion of ground *cannabis* into the first capsule mold to form a first *cannabis* puck. The method also includes attaching a first cover to the tray to cover the first *cannabis* puck in the first capsule mold. The method also includes attaching a first pull tab to the first cover. The first pull tab is configured to be grasped by a user when the user removes the first cover from covering the first *cannabis* puck in the first capsule mold.

20 Claims, 17 Drawing Sheets

(56) References Cited

U.S. PATENT DOCUMENTS

| | | | |
|---|---|---|---|
| 2017/0312178 | A1 | 11/2017 | Patel |
| 2019/0297938 | A1 | 10/2019 | Sidani |
| 2020/0405686 | A1 | 12/2020 | Wagner et al. |
| 2021/0022388 | A1 | 1/2021 | Sullivan |
| 2022/0160025 | A1 | 5/2022 | Williamson |
| 2024/0139268 | A1 | 5/2024 | Neault et al. |

FOREIGN PATENT DOCUMENTS

| | | | |
|---|---|---|---|
| WO | WO-2016/187696 | A1 | 12/2016 |
| WO | WO-2019/140237 | A1 | 7/2019 |

OTHER PUBLICATIONS

Huue, Huue Plant-Based Vapes—An All-New, Fresh Pressed Cannabis Experience, 2021, retrieved from https://www.huue.co/ on Jun. 7, 2023, 7 pages.

Marijuana Packaging, Futurola Knockbox, https://marijuanapackaging.com/products/futurola-knockbox-3-pre-roll-machine-w-standard-filling-kit-fill-100-pre-rolls-in-2-minutes [accessed Jun. 16, 2023].

Nugg Team, "CannaCloud: The First Single-Use, Pod-Based Cannabis Vaporizer," Nugg, retrieved from https://getnugg.com/blog/cannacloud-first-single-use-cannabis-vaporizer/ on Jan. 9, 2023, 2 pages (2015).

Nugg Team, CannaCloud: The First Single-Use, Pod-Based Cannabis Vaporizer, Nov. 18, 2015, https://getnugg.com/blog/cannacloud-first-single-use-cannabis-vaporizer/ [accessed Jun. 16, 2023].

* cited by examiner

METHODS FOR PACKAGING CANNABIS

CROSS-REFERENCE TO RELATED APPLICATIONS

This application is a continuation of U.S. patent application Ser. No. 18/336,729, filed Jun. 16, 2023, the entire contents of which are incorporated by reference herein.

BACKGROUND

Portions of *cannabis* may be sealed in a package for sale. Further, the *cannabis* may be part of a *cannabis* mixture that incorporates other elements such as a binder. The *cannabis* or the *cannabis* mixture may then be removed from the package and placed into a pipe or other smoking device for consumption. However, a package containing a relatively large portion of the *cannabis*, such as *cannabis* buds or unground *cannabis*, or *cannabis* mixture may make portioning for consumption difficult. For example, a user may desire to divide, such as separating *cannabis* buds from stems and grinding the *cannabis* buds, the relatively large portion into smaller portions. This may require the user to estimate that the smaller portions are of a suitable size for consumption, which can be tedious and lead to waste.

SUMMARY

One embodiment is directed towards a method for packaging *cannabis*. The method includes placing a first *cannabis* mixture into a first capsule mold of a tray. The method also includes pressing the first *cannabis* mixture into a first inside surface of the first capsule mold to form a first *cannabis* puck. The first inside surface is rounded in two directions. The method also includes attaching a first cover to the tray to cover the first *cannabis* puck in the first capsule mold.

Another embodiment is directed toward a method for packaging *cannabis*. The method includes mixing a *cannabis* mixture. The *cannabis* mixture includes a portion of ground *cannabis* and a binder. The binder is configured to bond together the portion of ground *cannabis*. The method also includes placing the *cannabis* mixture into a capsule mold of a tray. The method also includes pressing the *cannabis* mixture into the capsule mold of the tray to form a *cannabis* puck. The method also includes adhering a film cover to the tray to cover the *cannabis* puck in the capsule mold.

Yet another embodiment is directed toward a method for packaging *cannabis*. The method includes placing a first *cannabis* mixture into a first capsule mold of a tray. The method also includes placing a second *cannabis* mixture into a second capsule mold of the tray. The method also includes pressing the first *cannabis* mixture into the first capsule mold to form a first *cannabis* puck while pressing the second *cannabis* mixture into the second capsule mold to form a second *cannabis* puck simultaneously.

Figure 1:
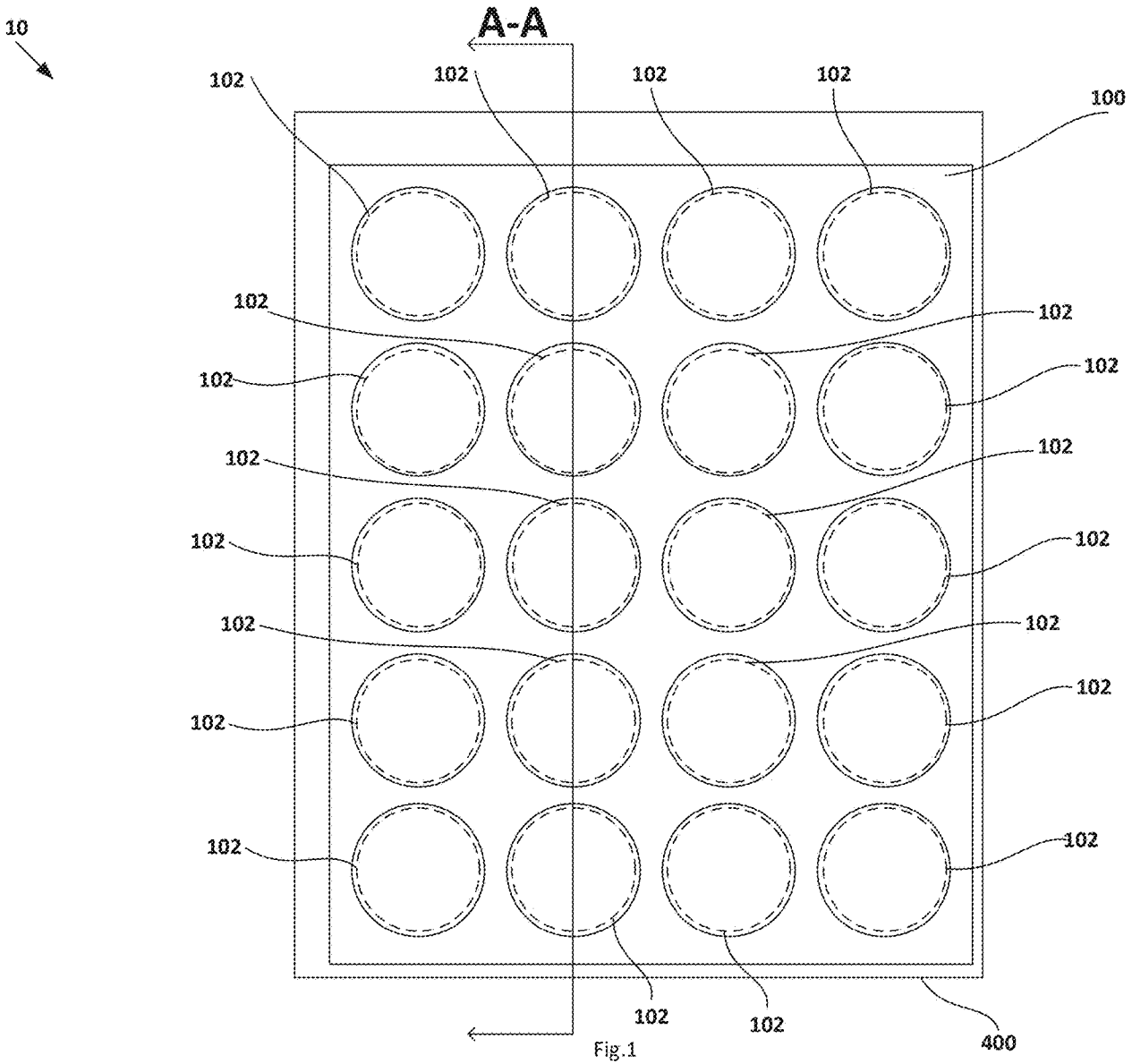
FIG. 1 is a top view of an example *cannabis* pack.

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and for packaging *cannabis*. The various concepts introduced above and discussed in greater detail below may be implemented in any of a number of ways, as the described concepts are not limited to any particular manner of implementation. Examples of specific implementations and applications are provided primarily for illustrative purposes.

I. Overview

Some methods of packaging include placing a *cannabis* mixture (e.g., *cannabis* flowers, *cannabis* buds, *cannabis* trichomes, etc.) in a package (e.g., a bag, a container, etc.). For example, the *cannabis* mixture may be placed in a bag and sold in stores. After being purchased, a user typically portions (e.g., divides, allocates, etc.) the *cannabis* mixture further into a dose (e.g., a portion, a serving, etc.), grinds the *cannabis* mixture, and then places the ground *cannabis* mixture in a bowl (e.g., a receptable, etc.) of a smoking device (e.g., a pipe, a bubbler, etc.) before igniting the ground *cannabis* mixture (e.g., to smoke, to inhale, etc.).

A user may portion the *cannabis* mixture into the dose by eye (e.g., by estimating, etc.) or using a scale (e.g., by weighing out an amount, etc.). For example, the user may portion the *cannabis* mixture based on previous experiences. The user may also place the portion of the *cannabis* mixture on a scale in order to obtain a predetermined amount of *cannabis* mixture. However, because these systems require previous knowledge of an ideal portion of the *cannabis* mixture, they are undesirable for beginners who may not know these ideal portions. It may be difficult for a beginner user to portion an intended amount of the *cannabis* mixture because they do not have the required previous knowledge of an ideal portion. As a result, the beginner user may incorrectly portion the *cannabis* mixture into the dose and experience undesirable results (e.g., not getting high, getting too high, etc.). Additionally, different types of *cannabis* mixtures may have different concentrations of active ingredients (e.g., Tetrahydrocannabinol (THC), Cannabidiol (CBD), etc.). As a result, a user having experience with a different *cannabis* mixture may incorrectly portion the *cannabis* mixture into the dose and also experience undesirable results.

Additionally, *cannabis* products that require a user to portion the *cannabis* mixture may be difficult for users with disabilities (e.g., multiple sclerosis, muscular dystrophy, Alzheimer's, etc.). For example, a user with cerebral palsy may have reduced motor function. It may be difficult for the user with cerebral palsy to portion the *cannabis* mixture, grind the *cannabis* mixture, and place the ground *cannabis* mixture into a bowl because of impaired motor function, for example.

Rather than requiring a user to portion the *cannabis* mixture, some methods of packaging *cannabis* include portioning the *cannabis* mixture into a dose and compressing the *cannabis* mixture into a *cannabis* puck. However, these *cannabis* pucks may not be correctly sized to fit into a bowl (e.g., compressed to fit inside a vaporizer, etc.). As a result, the *cannabis* puck may not be able to be used in a method preferred by a user (e.g., smoke *cannabis* from a pipe, etc.).

Additionally, these *cannabis* pucks may be manufactured using multiple molds. For example, the *cannabis* pucks may be compressed in a first mold and then transferred to a container (e.g., package, capsule, etc.). As a result, this method of packaging *cannabis* may require a manufacturer to handle the *cannabis* pucks multiple times, which increases the manufacturing cost. As another result, the manufacturer must retain additional equipment and floor space for the multiple molds in order to create the compressed puck.

Implementations described herein are related to a method of packaging *cannabis* that does not require a user to portion the *cannabis* mixture. Instead, the *cannabis* mixture is packaged into an optimal dose in the form of a *cannabis* puck. As a result, the user may utilize the *cannabis* puck without having any previous knowledge of an ideal portion of the *cannabis* mixture and may expect a consistent dosage of active ingredients. Additionally, the method of packaging *cannabis* described herein includes compressing the *cannabis* mixture into the *cannabis* puck inside of a capsule mold and then sealing the *cannabis* puck into the capsule mold. As a result, a manufacturer is able to efficiently form and subsequently package the *cannabis* puck without handling the *cannabis* puck to move it from a mold to a separate package. Thus, the manufacturer is able to quickly seal the *cannabis* puck inside of the capsule mold and reduce manufacturing costs associated with use of separate mold and packaging.

II. Overview of *Cannabis* Package

Figure 2:
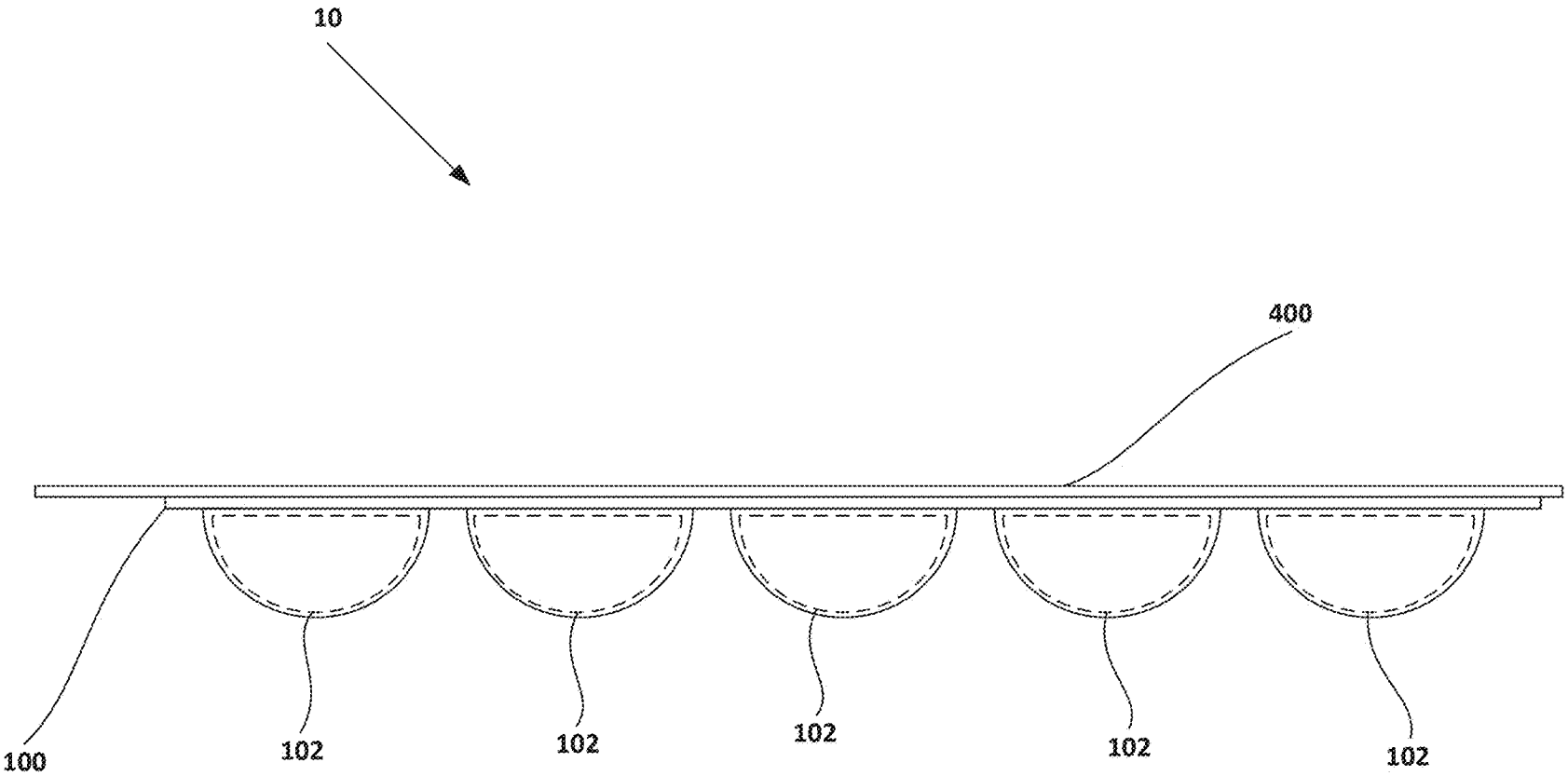
FIG. 2 is a side view of the *cannabis* pack of FIG. 1.
Figure 3:
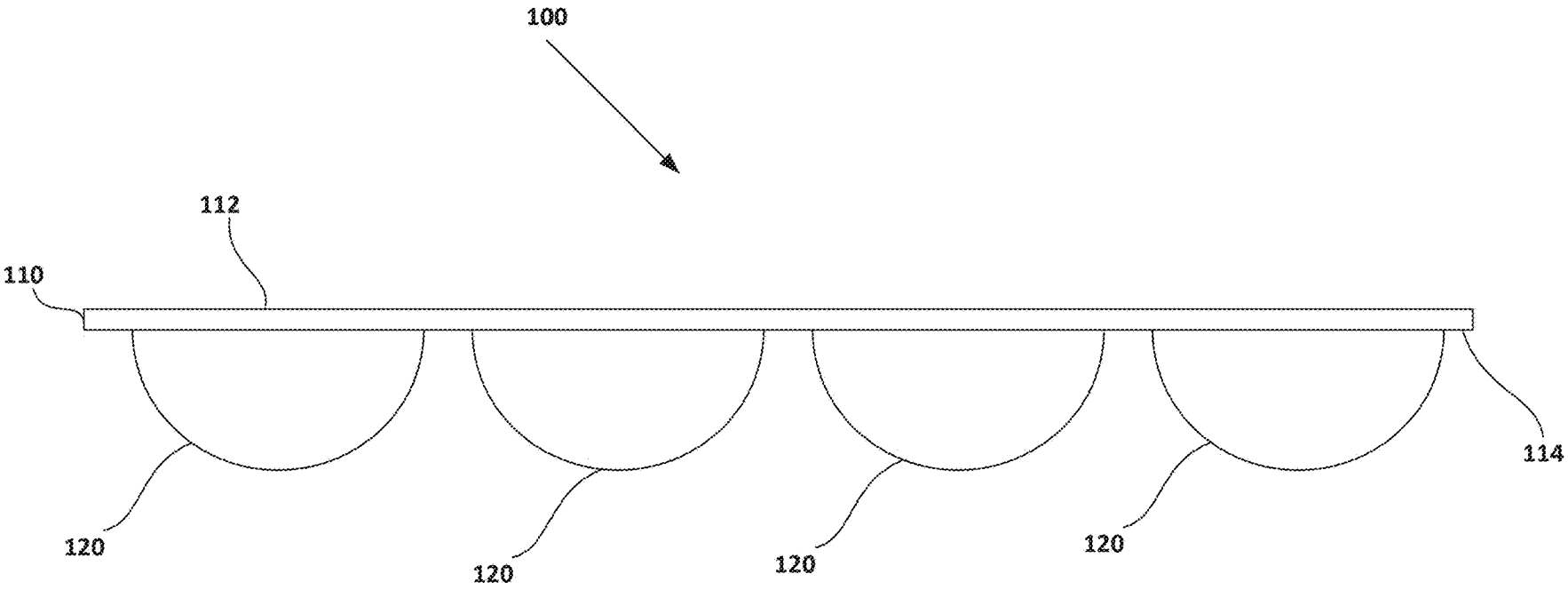
FIG. 3 is a side view of a tray of the *cannabis* pack of FIG. 1.
Figure 4:
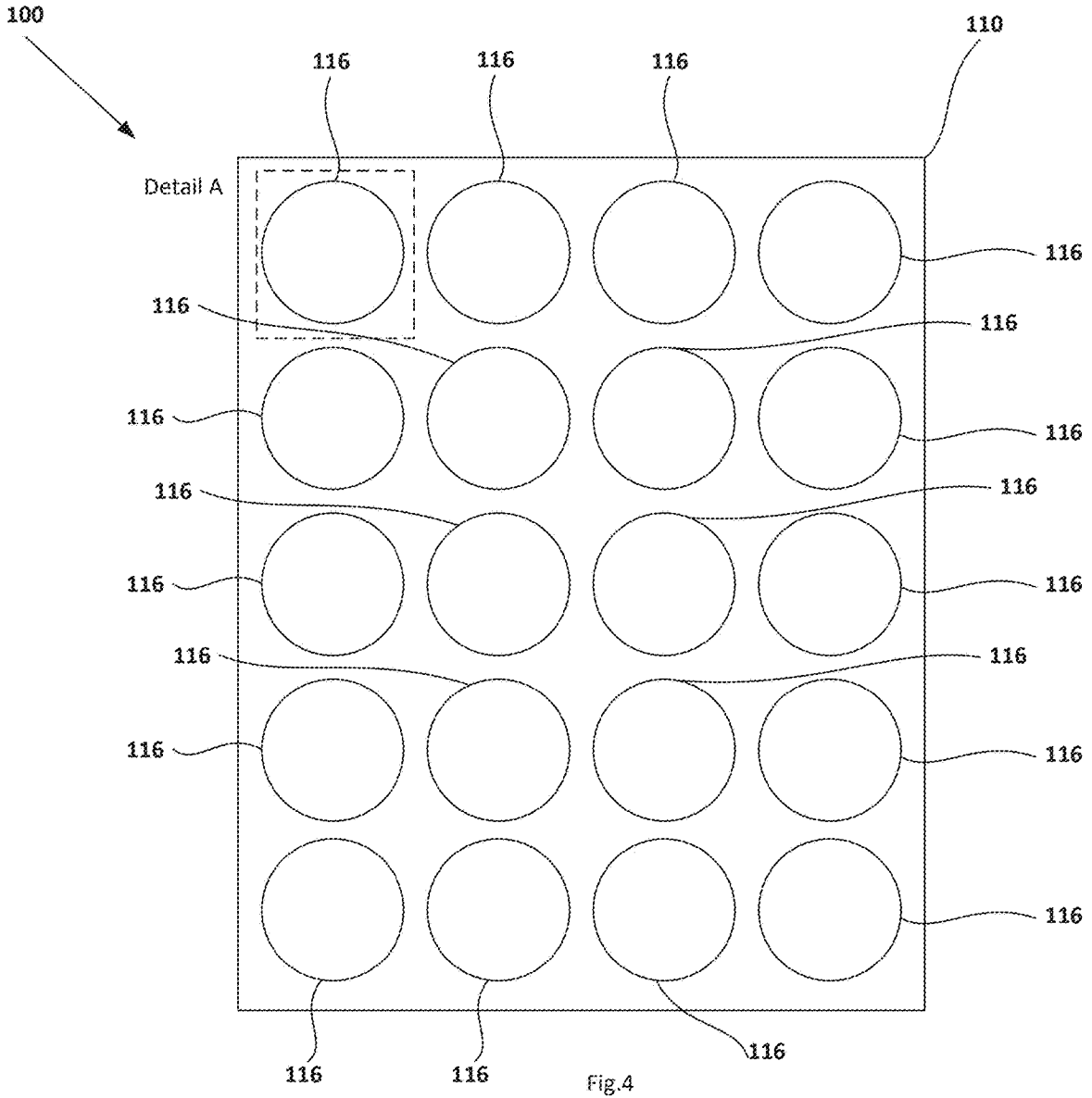
FIG. 4 is a top view of the tray of FIG. 1.
Figure 5:
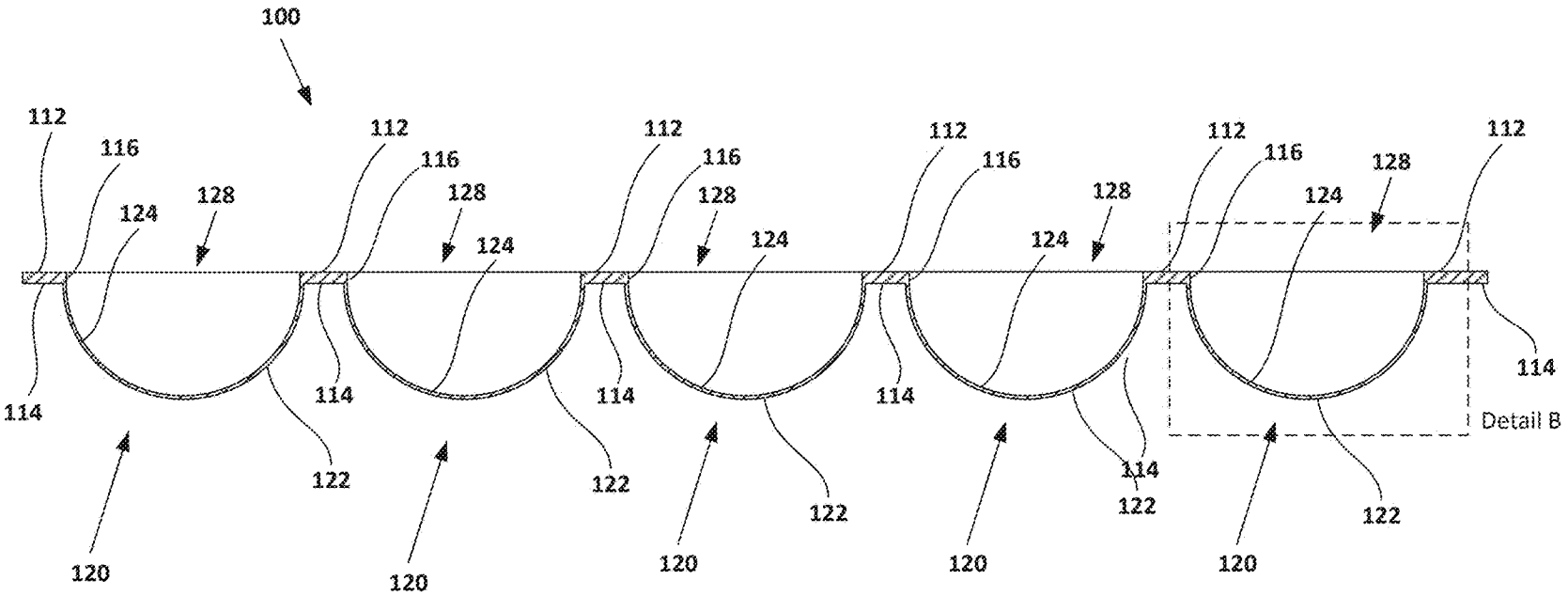
FIG. 5 is a cross-section view of the tray of FIG. 1 taken along plane A-A.
Figure 6:
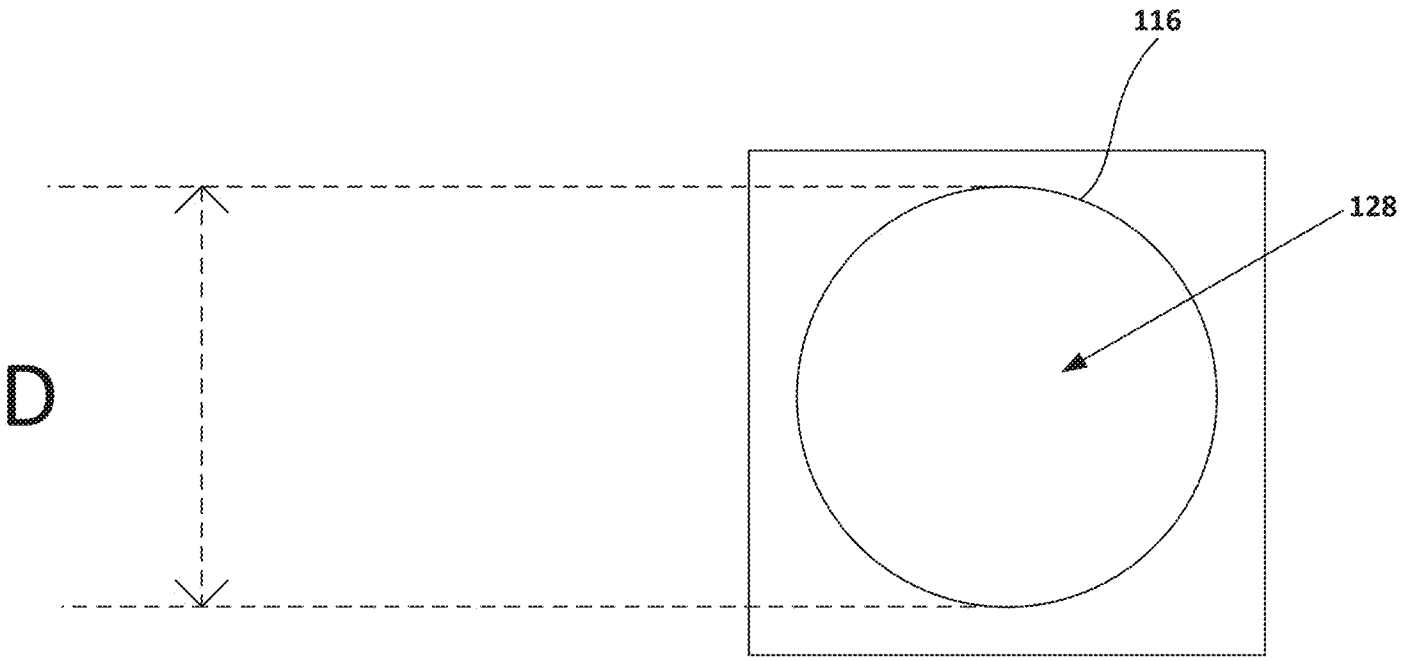
FIG. 6 is a view of Detail A of FIG. 4.
Figure 7:
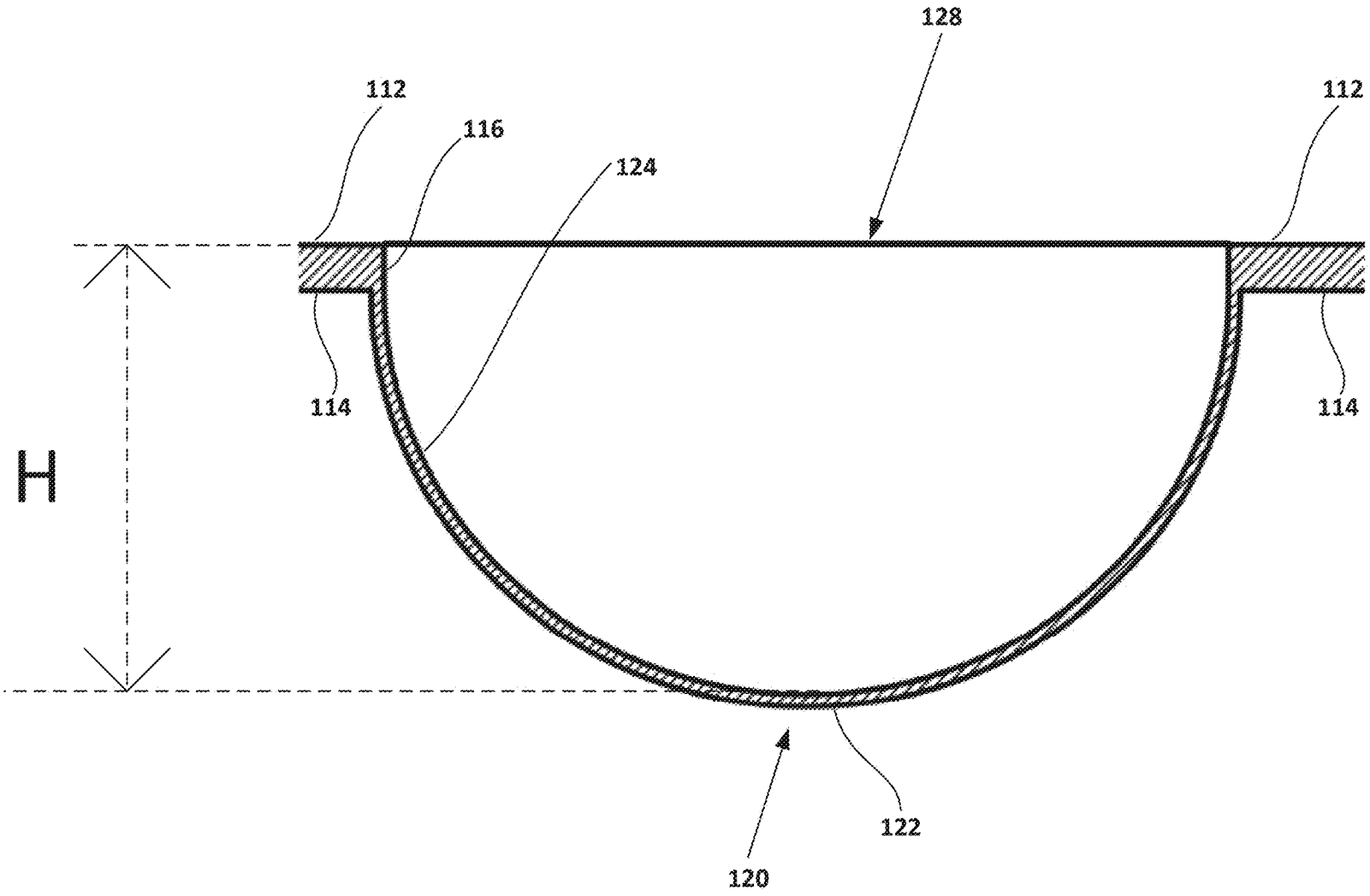
FIG. 7 is a view of Detail B of FIG. 5.
Figure 8:
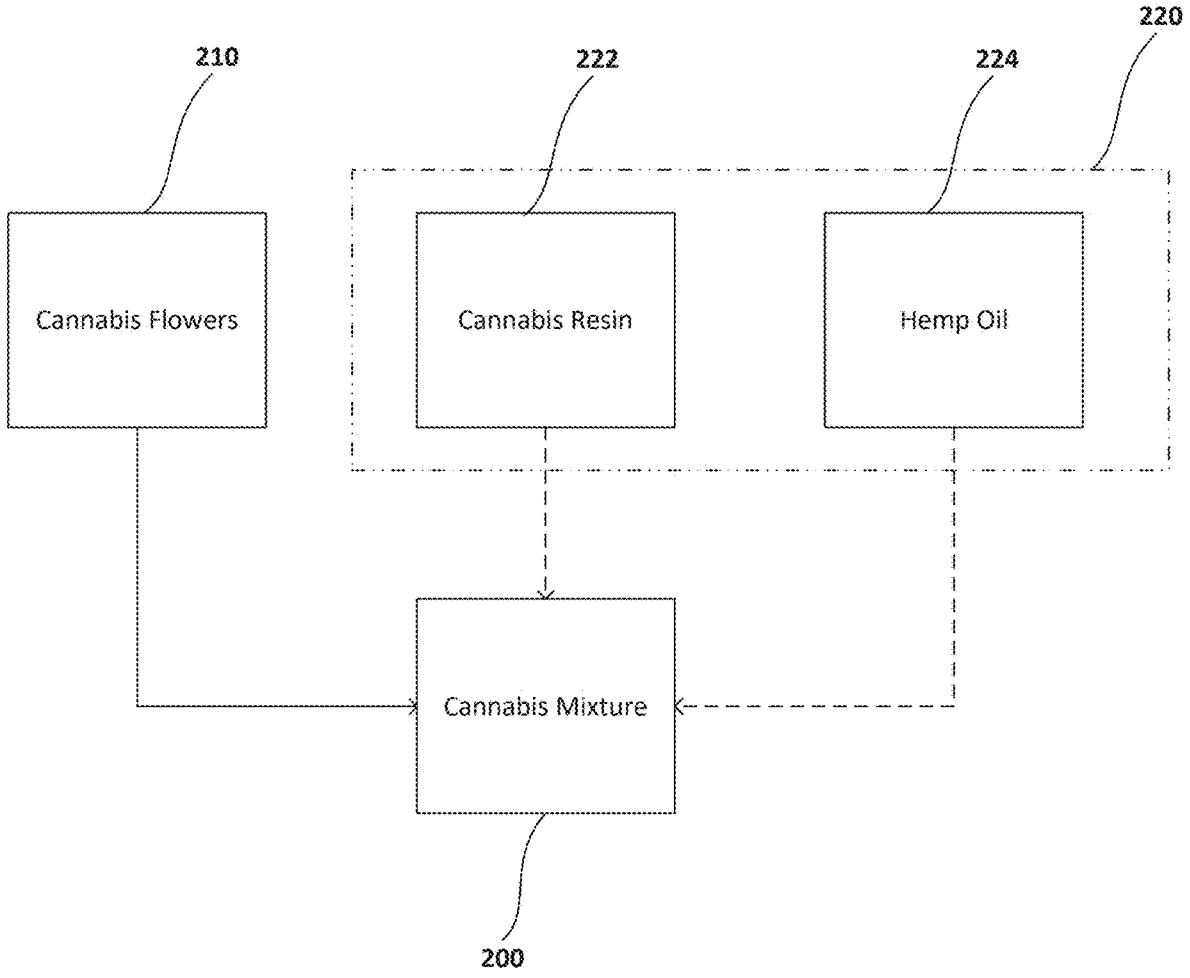
FIG. 8 is a block diagram of a *cannabis* mixture.
Figure 9:
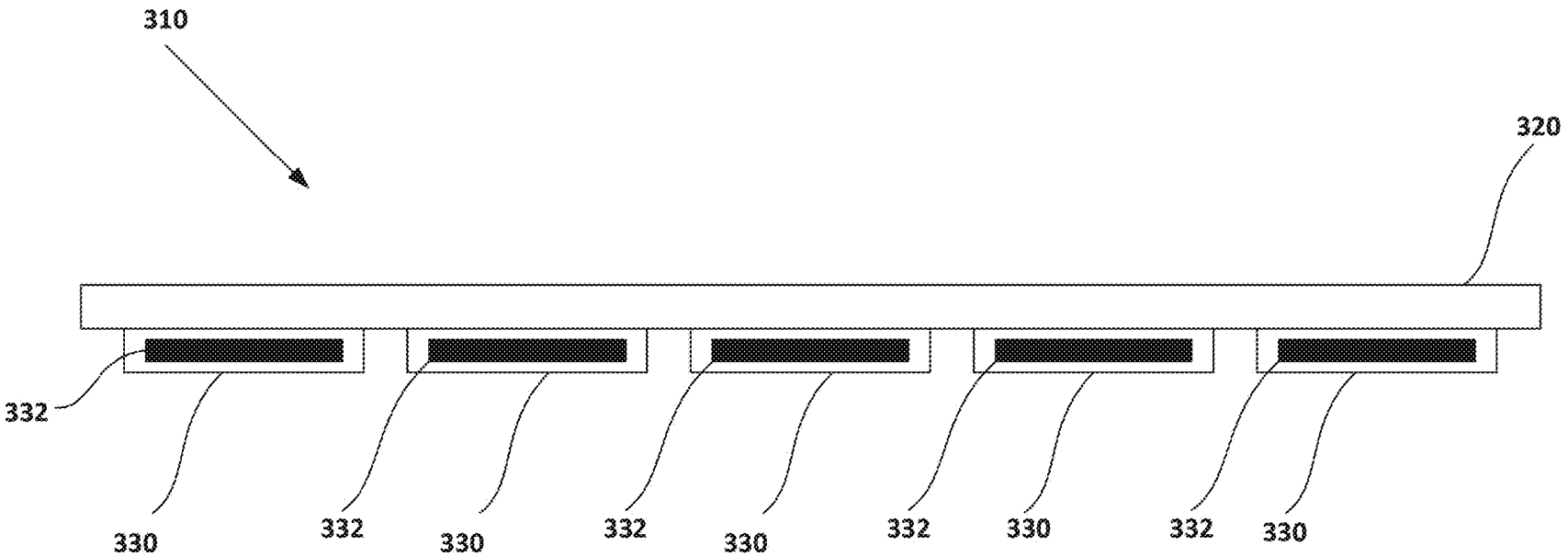
FIG. 9 is a side view of an example press.
Figure 10:
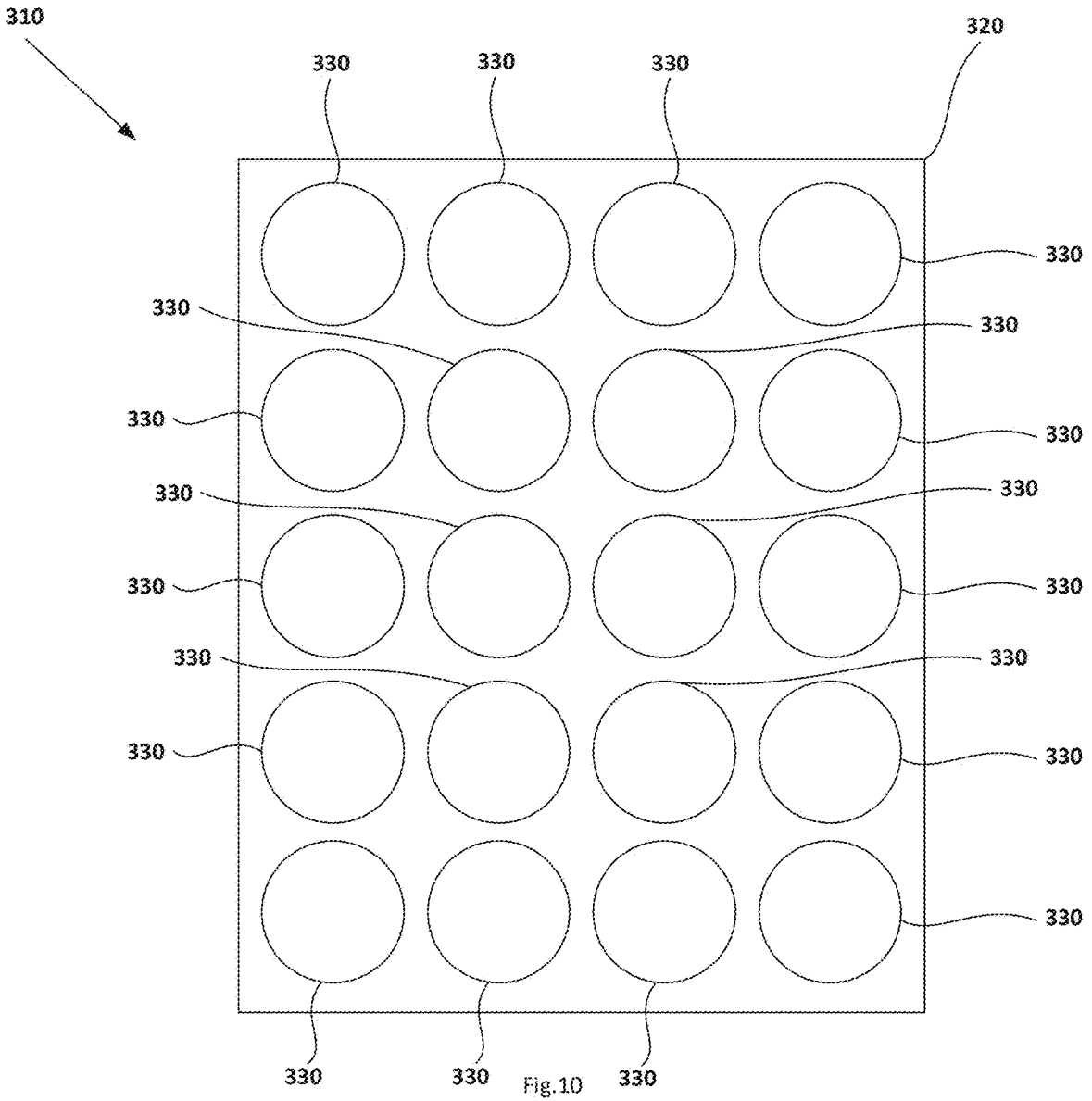
FIG. 10 is a bottom view of the press of FIG. 9.
Figure 11:
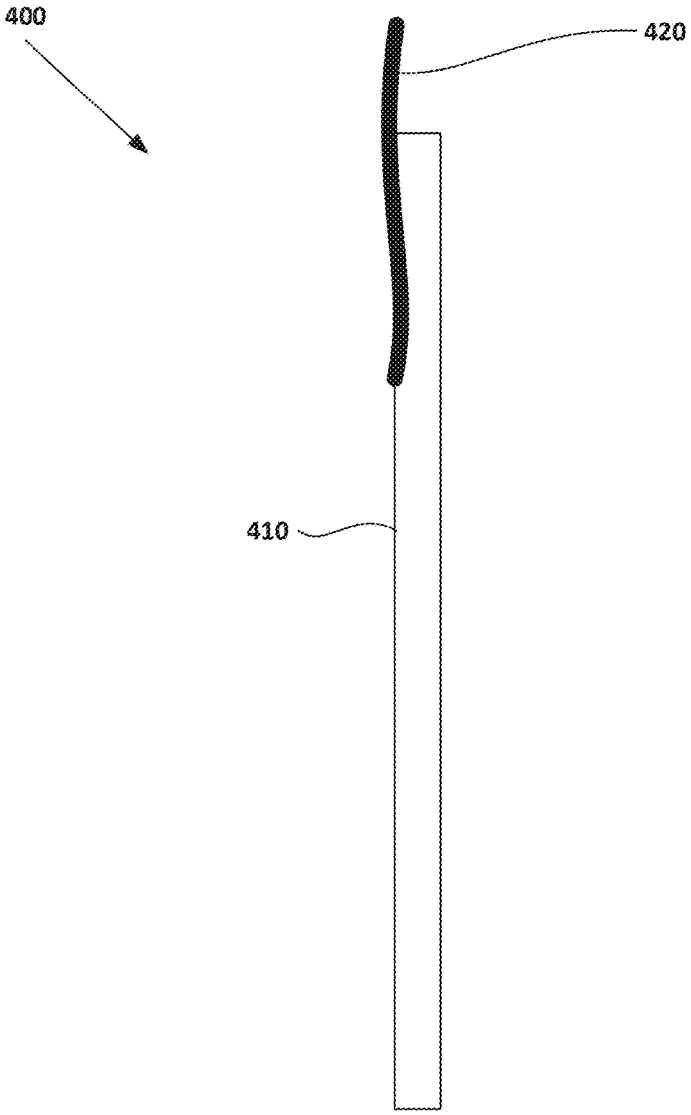
FIG. 11 is a side view of a film cover of the *cannabis* pack of FIG. 1.

FIG. 1 depicts an example *cannabis* pack 10 (e.g., a *cannabis* box, a *cannabis* package, a *cannabis* container, etc.). As is described in more detail herein, the *cannabis* pack 10 is configured to store one or more *cannabis* pucks 102 for purchase. The *cannabis* puck 102 is shown in FIG. 1 and FIG. 2 in dashed (e.g., phantom, etc.) lines. In some embodiments, the *cannabis* pack 10 is configured to store a plurality of the *cannabis* pucks 102 (e.g., a first *cannabis* puck 102, a second *cannabis* puck 102, etc.) for purchase. Each of the *cannabis* pucks 102 may be removed and consumed by a user. Importantly, as described in more detail herein, the *cannabis* pack 10 facilitates formation of the *cannabis* pucks 102 (e.g., from a *cannabis* mixture) in addition to storage of the *cannabis* pucks 102.

The *cannabis* pack 10 includes a tray 100 (e.g., platter, container, etc.). The tray 100 is configured to support the *cannabis* puck 102 during formation and storage. The tray 100 includes a tray plate 110 (e.g., board, plate, etc.). As described in more detail herein tray plate 110 is configured to support a mold that facilitates the formation of the *cannabis* puck 102 and couple to a cover that covers the *cannabis* puck 102 after it has been formed. The tray plate 110 defines a tray top 112 (e.g., a top surface, etc.) and a tray bottom 114 (e.g., a bottom surface, etc.). The tray 100 also defines a tray aperture 116 (e.g., a hole, an opening, etc.). The tray aperture 116 is configured to allow material to pass through the tray plate 110. In some embodiments, the tray 100 defines a plurality of tray apertures 116 (e.g., a first tray aperture 116, a second tray aperture 116, etc.). The tray aperture 116 defines an aperture diameter D. In some embodiments, the aperture diameter D is between 18 millimeters to 22 millimeters. In other embodiments, the aperture diameter D is less than 18 millimeters. In still other embodiments, the aperture diameter D is greater than 22 millimeters. In some embodiments, the tray aperture 116 is generally round (e.g., circular, ovular, etc.). In other embodiments, the tray aperture 116 may take on a different shape (e.g., a square, a rectangle, etc.).

The tray 100 also includes a capsule mold 120 (e.g., a compartment cast, a mold, etc.). The capsule mold 120 is coupled to the tray bottom 114. In some embodiments, the tray plate 110, the tray aperture 116, and the capsule mold 120 of the tray 100 are integrally formed (e.g., injection molded, form a single body, etc.). In over embodiments, one or more components of the tray 100 are otherwise coupled together (e.g., fastened, adhesively coupled, etc.). The capsule mold 120 is configured to receive and store the *cannabis* puck 102. The capsule mold 120 is also configured as a mold (e.g., a die, a cast, etc.) that allows for the *cannabis* puck 102 to be pressed (e.g., compressed, compacted, etc.) into the capsule mold 120. The capsule mold 120 is made of a rigid material (e.g., rigid plastic, steel, aluminum, etc.) that resists deformation (e.g., changes in shape, etc.) when a predetermined compressive force (e.g., force required to form the *cannabis* puck 102, etc.) is applied to the *cannabis* puck 102 inside of the capsule mold 120. In some embodiments, the capsule mold 120 is made a rigid material (e.g., rigid plastic, steel, aluminum, etc.) that it does not deform when the predetermined compressive force is applied to the *cannabis* puck 102 inside of the capsule mold 120.

The capsule mold 120 is contiguous with (e.g., shares a border with, etc.) the tray aperture 116. In some embodiments, the tray 100 includes a plurality of capsule molds 120 (e.g., a first capsule mold, a second capsule mold, etc.) and each of capsule molds 120 are coupled to the tray bottom 114 and are contiguous with one of tray apertures 116.

The capsule mold 120 defines a capsule exterior 122 (e.g., outside surface, etc.). The capsule exterior 122 is configured to support (e.g., hold, rest on, etc.) the tray 100 when it is placed on a surface (e.g., a table, a shelf, etc.). In some embodiments, the capsule exterior 122 is rounded in two directions (e.g., a semi-sphere, a bulge, etc.) In other embodiments, the capsule exterior 122 has a different shape (e.g., a cube shape, an oval shape, etc.). In some embodiments, the capsule exterior 122 is configured to support the tray 100 when the *cannabis* puck 102 is pressed into the capsule mold 120.

The capsule mold 120 also defines a capsule interior 124 (e.g., an inside surface, etc.). The capsule interior 124 is configured to support (e.g., hold, contain, etc.) the *cannabis* puck 102. The capsule interior 124 is rounded in two perpendicular or near perpendicular directions (e.g., semi-sphere, bulge, etc.). The capsule interior 124 defines a first radius of curvature in a first direction and a second radius of curvature in a second direction perpendicular or near perpendicular to the first direction. In some embodiments, the first radius of curvature and the second radius of curvature are equal such that the capsule interior 124 forms a semi-sphere. In other embodiment, the firs radius of curvature is greater than the second radius of curvature. In still other embodiments, the second radius of curvature is greater than the first radius of curvature. The capsule interior 124 may be entirely rounded such that a rounded portion of the capsule interior 124 extend from the shared border with the tray aperture 116. In other embodiments, the rounded portion of the capsule interior 124 may not extend from the shared border with the tray aperture 116 (e.g., the capsule interior 124 may extend straight down from the tray aperture 116 before rounding, etc.). The capsule interior 124 may be rounded in two perpendicular directions match an inside surface (e.g., an inside profile, etc.) of a bowl (e.g., receptacle, chamber for holding an ignited substance, etc.) of a device for smoking a substance (e.g., a bong, a smoking pipe, etc.) such that an object shaped with a confronting relation to the capsule interior 124 can be placed into the bowl of the device for smoking a substance. In other embodiments, the capsule interior 124 has a different shape (e.g., a cube shape, an oval shape, etc.). In some embodiments, the capsule molds 120 each define a capsule interior 124 (e.g., a first inside surface, a second inside surface, etc.). The capsule interior 124 may be embossed (e.g., raised, extruded, etc.) or debossed (e.g., sunken, etc.) with a signifier (e.g., icon, mark, logo, etc.). The signifier may be a brand name (e.g., logo, etc.) or an identifier of the *cannabis* puck 102 (e.g., THC concentration, *cannabis* strain, etc.) In operation, the embossed or debossed signifier may be imprinted (e.g., etched, transferred, etc.) from the capsule interior 124 to the *cannabis* puck 102 when the *cannabis* puck 102 is pressed into the capsule interior 124 such that the *cannabis* puck 102 is marked with (e.g., displays, presents, etc.) the signifier. The capsule interior 124 may also be covered with a coating (e.g., a spray, an enamel, etc.) configured to reduce the adherence between the capsule interior 124 and the *cannabis* puck 102.

The capsule interior 124 and the tray top 112 define a capsule height H (e.g., a depth of the capsule, etc.) from the tray top 112 to the bottom of the capsule interior 124. In some embodiments, the capsule height H is between 8 millimeters and 12 millimeters, inclusive. In other embodiments, the capsule height H is less than 8 millimeters. In still other embodiments, the capsule height H is greater than 12 millimeters.

The capsule interior 124 and the tray top 112 also define a capsule void 128 (e.g., an empty space, a compartment, etc.). The capsule void 128 is configured to store (e.g., fit, contain, etc.) the *cannabis* puck 102. In some embodiments, each of the capsule interiors and the tray top 112 also define a plurality of capsule voids 128. Each of the capsule voids 128 is configured to store one of the *cannabis* pucks 102.

The *cannabis* puck 102 starts as a *cannabis* mixture 200 (e.g., a *cannabis* blend, a *cannabis* compound, etc.). The *cannabis* mixture 200 includes a portion of ground *cannabis* 210. The portion of ground *cannabis* 210 is made up of ground *cannabis* flower that has been ground down to a specific ground size. The portion of ground *cannabis* 210 contains an amount of THC and other active ingredients (e.g., CBD, etc.). In some embodiments, an additive may be added to the *cannabis* mixture 200 to reduce the adherence between the *cannabis* mixture 200 and the capsule interior 124.

In some embodiments, the *cannabis* mixture 200 also includes a binder 220 (e.g., a *cannabis* concentrate, a thickener, a glue, etc.). The binder 220 is configured to bind together (e.g., connect, etc.) the portion of the ground *cannabis* 210 when a compressive force 300 (e.g., a compacting force, a pressing force, etc.) is applied to the *cannabis* mixture 200. The binder 220 includes at least one of a portion of *cannabis* resin 222 or a portion of hemp oil 224 (e.g., full spectrum CBD oil, broad spectrum CBD oil, etc.). The portion of *cannabis* resin 222 is a sticky substance that may be produced from *cannabis* trichomes by applying heat and pressure to the *cannabis* trichomes. The sticky nature of the portion of *cannabis* resin 222 allows it to bind together the portion of ground *cannabis* 210 when a compressive force 300 is applied to the *cannabis* mixture 200. The portion of hemp oil 224 is an oil that may be produced by cold pressing hemp seeds from a hemp plant. The portion of hemp oil 224 may be mixed with the portion of ground *cannabis* 210 to create a paste which becomes a solid when a compressive force 300 is applied to the *cannabis* mixture 200. In some embodiments, the binder 220 includes both the portion of *cannabis* resin 222 and the portion of hemp oil 224. In other embodiments, the *cannabis* mixture 200 does not include the binder 220 and the ground *cannabis* 210 is configured to bind itself together when a compressive force 300 is applied to the *cannabis* mixture 200 or by a combination of the compressive force 300 and heat applied to the *cannabis* mixture 200.

The *cannabis* mixture 200 is placed into the capsule mold 120 through the tray aperture 116. The *cannabis* mixture 200 weighs between 0.30 grams and 0.40 grams. In other embodiments, the *cannabis* mixture 200 weighs less than 0.30 grams. In still other embodiments, the *cannabis* mixture 200 weighs more than 0.40 grams. The *cannabis* mixture 200 also contains between 8 milligrams and 12 milligrams of THC. In other embodiments, the *cannabis* mixture 200 contains less than 8 milligrams of THC. In still other embodiments, the *cannabis* mixture 200 contains greater than 12 milligrams of THC. In some embodiments, a plurality of *cannabis* mixtures 200 (e.g., a first *cannabis* mixture 200, a second *cannabis* mixture 200, etc.) are each placed into one of the capsule molds 120.

In some embodiments, the compressive force 300 may be applied to the *cannabis* mixture 200 using a press 310 (e.g., a compactor, a puck maker, etc.). In other embodiments, the compressive force 300 may be applied to the *cannabis* mixture 200 by hand (e.g., manually applying the compressive force 300, etc.). The press 310 includes a press plate 320. The press plate 320 is configured to receive a force or a pressure and transfer the force or the pressure to a component described herein.

The press 310 also includes a press cylinder 330 (e.g., a tamper, a compressor rod, etc.). The press cylinder 330 is coupled to a bottom face of the press plate 320. The press cylinder 330 is configured to drift (e.g., pass through, etc.) the tray aperture 116 of the tray 100. In some embodiments, the press 310 includes a plurality of press cylinders 330 coupled to the bottom face of the press plate 320 and each are configured to drift one of tray apertures 116 of the tray 100. A bottom face of the press cylinder 330 may contain an embossed or debossed signifier. The signifier may be a brand name or an identifier of the *cannabis* mixture 200 (e.g., THC concentration, *cannabis* strain, etc.). In some embodiments, the bottom face of the press cylinder 330 is textured (e.g., with bumps, with ridges, etc.). A textured bottom face of the press cylinder 330 creates a textured surface on the *cannabis* mixture 200 which may ease the ignition of the *cannabis* mixture 200 (e.g., allow for more surface area to be ignited, allow for oxygen to reach more of a surface of, etc.) after compression. The bottom face of the press cylinder 330 may also be covered with a coating (e.g., a spray, an enamel, etc.) configured to reduce the adherence between the bottom face of the press cylinder 330 and the *cannabis* mixture 200.

The press 310 also includes a heater 332 (e.g., a resistance heater, an electrical heater, a thermoelectric heater, a piezoelectric heater, etc.). In various embodiments, the heater 332 is coupled to the press cylinder 330. For example, the press cylinder 330 may include a recess and the heater 332 may be inserted into the recess and coupled to the press cylinder 330 (e.g., using adhesive, etc.). The heater 332 may be configured to increase a temperature of the press cylinder 330 such that the temperature of the press cylinder 330. For example, the heater 332 may be configured to increase the temperature of the press cylinder 330 such that the temperature of the press cylinder 330 is higher than a surrounding ambient temperature. In some embodiments, the heater 332 is an electric heater (e.g., a heater that produces heat when supplied by electricity, etc.). In other embodiments, the heater 332 may be configured to heat the press cylinder 330 to a specific temperature (e.g., a temperature required to compress the *cannabis* mixture 200 into the *cannabis* puck 102, etc.). In other embodiments, the heater 332 is coupled to the press plate 320 so that the heater 332 increases the temperature of the press plate 320, which in turn increases the temperature of the press cylinder 330. In some embodiments, the press 310 includes a plurality of heaters 332 each coupled to one of the plurality of press cylinders 330. While not shown, a system includes a controller and a power source, in addition to the heater 332, the press cylinder 330, the press 310, and the press plate 320. The controller is configured to cause power from the power source to be provided to the heater 332 (e.g., to increase the temperature, etc.).

In operation, after the *cannabis* mixture 200 has been placed inside the capsule mold 120 of the tray 100, force is applied to the press plate 320. The press plate 320 transfers this force to the press cylinder 330. The press cylinder 330 applies the compressive force 300 on the *cannabis* mixture 200 which causes the binder 220 to bind together the portion of the ground *cannabis* 210 to form a *cannabis* puck 102. The press cylinder 330 may also apply heat from the heater 332 (e.g., the controller may cause power from the power source to be provided to the heater) to the *cannabis* mixture 200 which also causes the binder 220 to bind together the portion of the ground *cannabis* 210 to form a *cannabis* puck 102. In other embodiments the press cylinder 330 applies the compressive force 300 and heat from the heater 332 to the *cannabis* mixture 200 which causes the *cannabis* mixture 200 to bind itself together. The *cannabis* puck 102 is configured to be a solid or semi-solid composition with enough structural integrity to maintain its shape and form under environmental conditions and to have a relatively large surface to volume ratio. In some embodiments, the compressive force 300 may be transferred form the press plate 320 to the press cylinders 330. Each of the press cylinders 330 apply a portion of the compressive force 300 on one of the *cannabis* mixtures 200, which simultaneously form a plurality of *cannabis* pucks 102 (e.g., a first *cannabis* puck 102, a second *cannabis* puck 102, etc.).

The *cannabis* puck 102 defines a puck top 340 (e.g., a top surface, etc.). The puck top 340 is configured to match a profile of a bottom face of the press cylinder 330 after it has applied the compressive force 300 to the *cannabis* mixture 200. The puck top 340 may be embossed or debossed with the textures and signifiers present on the bottom face of the press cylinder 330. In other embodiments, the puck top 340 may also be embossed separately from receiving the compressive force 300 from the press cylinder 330 (e.g., after the press 310 has been removed, etc.). The puck top 340 may also be ignited when a user places the *cannabis* puck 102 into a pipe to smoke the *cannabis* puck 102. In some embodiments, the textures embossed or debossed on the puck top 340 may ease the ignition of the puck top 340 (e.g., allow for more surface area to be ignited, allow for oxygen to reach more of the puck top 340, etc.).

The *cannabis* puck 102 also defines a puck bottom 342 (e.g., a bottom surface, etc.). The puck bottom 342 is configured to match the capsule interior 124. The puck bottom 342 is formed when the compressive force 300 forces the *cannabis* mixture 200 against the capsule interior 124. The puck bottom 342 may be embossed or debossed with the textures and signifiers present on the capsule interior 124 of the capsule mold 120. In some embodiments, the puck bottom 342 is configured to accommodate a device such as a pipe or a bong. In these embodiments, the puck bottom 342 is configured with a confronting relation with a bowl of the device. The *cannabis* puck 102 can then be placed into the bowl of the device. The *cannabis* puck 102 is also configured to allow for smoke from the combustion of the puck top 340 to travel through *cannabis* puck 102 and emerge from the puck bottom 342.

In operation, a user may place the *cannabis* puck 102 into the device so that the puck bottom 342 contacts the bowl of the device. The user may then ignite a portion of the *cannabis* puck 102, such as the puck top 340, thereby causing combustion of a portion of the *cannabis* puck 102 and the production of smoke. The user may then inhale through a mouthpiece such that the smoke is drawn from the puck top 340 through the *cannabis* puck 102, through the puck bottom 342, and then through the device into the mouth of the user.

The *cannabis* pack 10 also includes a cover 400 (e.g., a film cover, a lid, etc.). The cover 400 is configured to be placed on the tray top 112 of the tray 100 and cover (e.g., obscure, seal, etc.) the tray aperture 116. In some embodiments, the cover 400 is configured to cover the tray apertures 116. In other embodiments, a plurality of covers 400 (e.g., a first cover 400, a second cover 400, etc.) are each configured to cover one of the tray apertures 116. The cover 400 is impermeable to air (e.g., to prevent contamination, etc.) and is opaque (e.g., to prevent degradation of the *cannabis* puck 102 by light, etc.). In other embodiments, the cover 400 is partially or fully clear (e.g., so a user may see the *cannabis* puck 102 through the film cover, etc.). In operation, after the compressive force 300 has formed the *cannabis* puck 102, the cover 400 is placed on the tray top 112 to cover the *cannabis* puck 102 located inside of the capsule mold 120.

In some embodiments the cover 400 includes an adhesive 410 (e.g., a glue, a binder, etc.). The adhesive 410 is bonded to a face of the cover 400. The adhesive 410 is configured to adhere to the tray top 112 of the tray 100 when the cover 400 is placed on the tray 100 to cover the capsule mold 120. In some embodiments, the adhesive 410 is configured to repeatedly releasably adhere to the tray 100. In this way, the cover 400 may be removed to expose the *cannabis* pucks 102 so that a user may remove one of the *cannabis* pucks 102 for consumption before re-adhering the cover 400 to the tray top 112 using the adhesive 410 to cover the *cannabis* pucks 102 remaining in the tray 100, thereby preventing the degradation of the *cannabis* pucks 102 remaining in the tray 100 by exposure to oxygen and/or light.

The cover 400 also includes a pull tab 420 (e.g., a handle, a string, etc.). The pull tab 420 is coupled to the cover 400 such that the pull tab 420 extends beyond the outside of the cover 400. In some embodiments, the pull tab 420 is adhered to the bottom surface of the cover 400 with the adhesive 410. In other embodiments, the pull tab 420 is coupled to the cover 400 using alternate means (e.g., thermal welding, integrated during manufacture, etc.). The pull tab 420 is configured to extend from the cover 400 when the cover 400 is adhered to the tray 100 such that it may be grasped (e.g., grabbed, handled, etc.) and pulled (e.g., yanked, lifted, etc.) to assist with removing the cover 400 from the tray 100. In some embodiments, one of a plurality of pull tabs 420 are coupled to each of the covers 400. In other embodiments, the pull tab 420 is coupled to the covers 400.

III. Overview of Method of Packaging *Cannabis*

Figure 12:
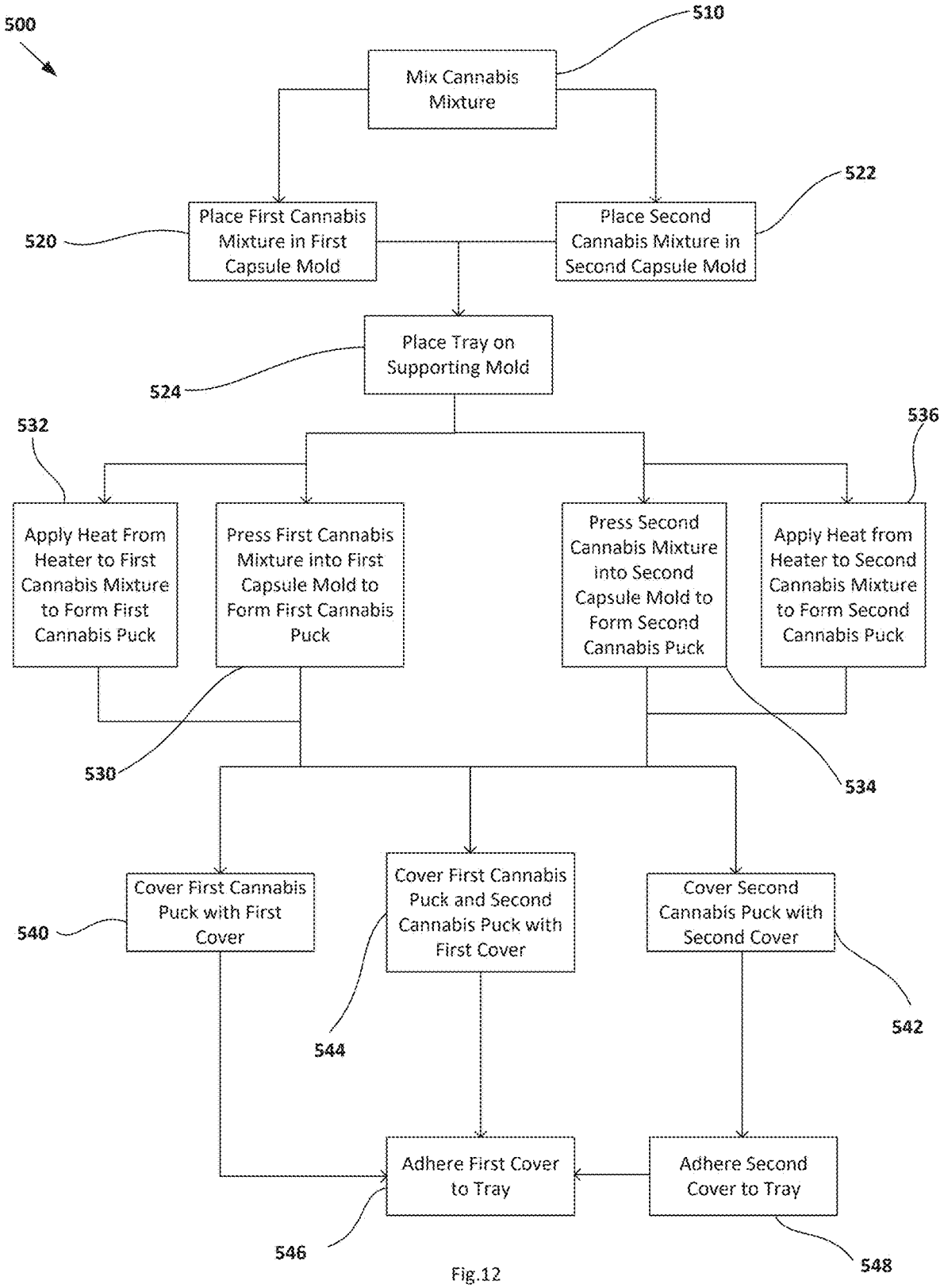
FIG. 12 is a block diagram of an example method for packaging *cannabis;*
Figure 13:
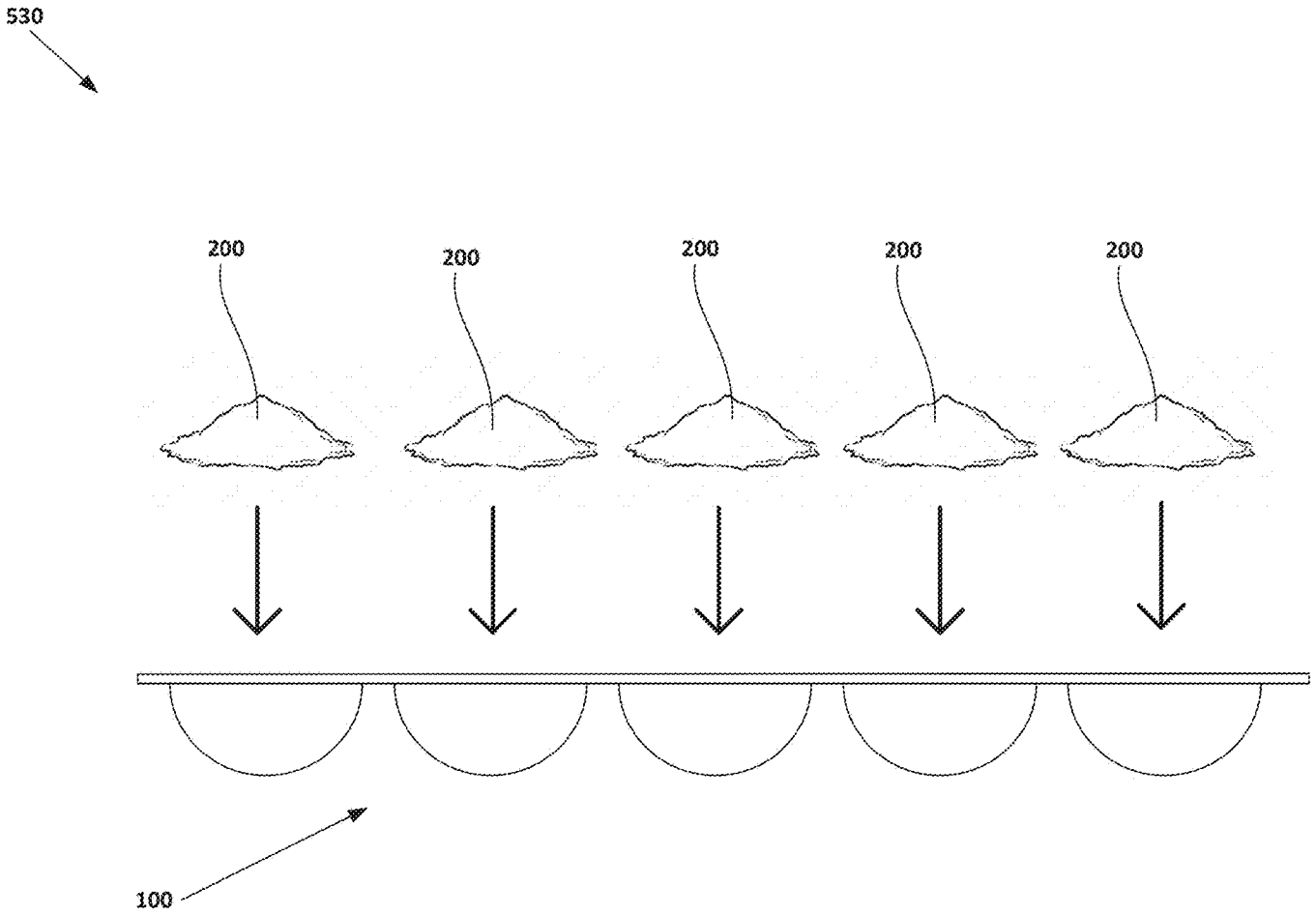
FIG. 13 is a side view of an example of a step of placing a *cannabis* mixture into a capsule mold of a tray of the method for packaging *cannabis* shown in FIG. 12.
Figure 14:
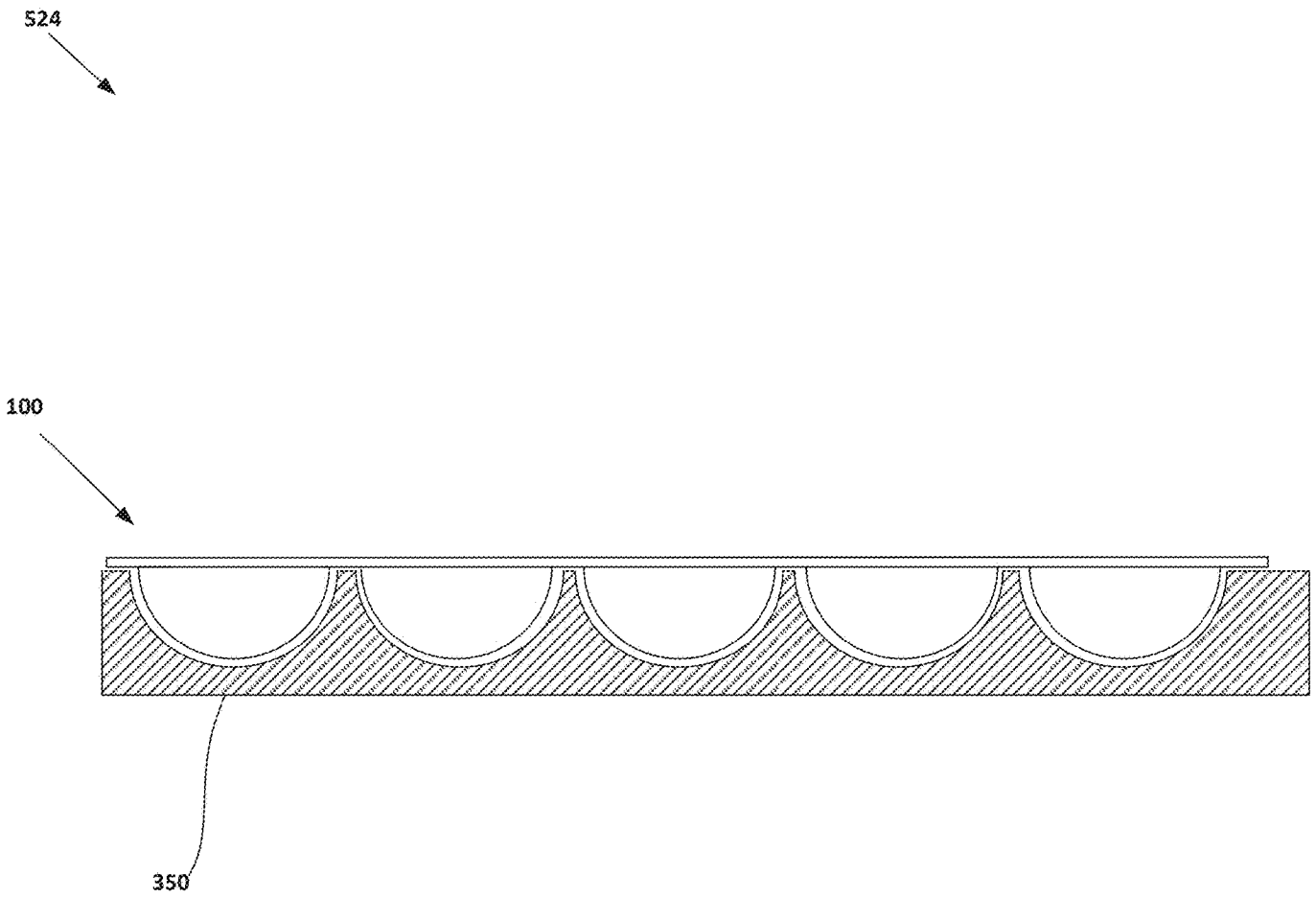
FIG. 14 is a side view of an example of a step of placing the tray on a supporting mold of the method for packaging *cannabis* shown in FIG. 12.
Figure 15:
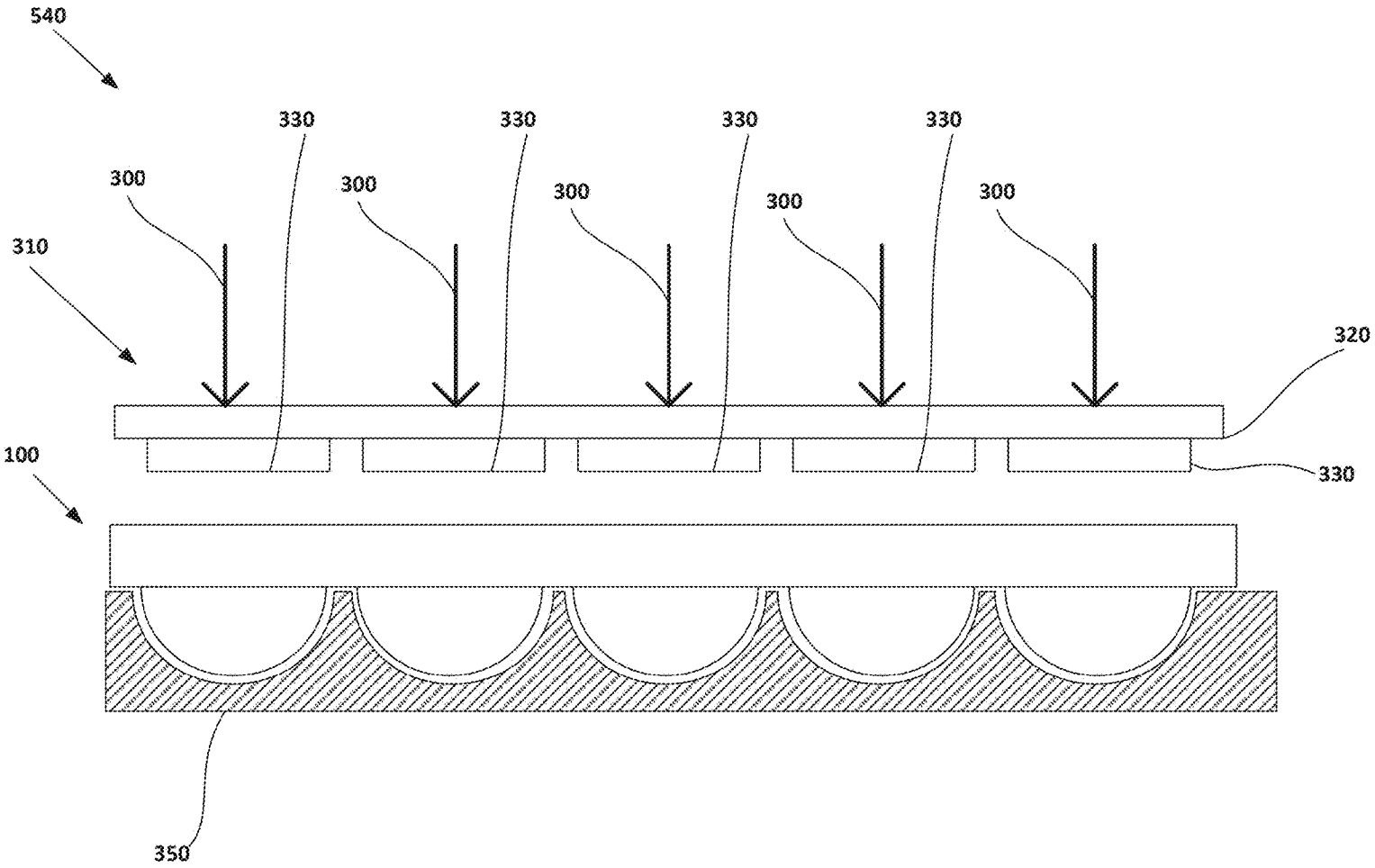
FIG. 15 is a side view of an example of a step of pressing the *cannabis* mixture into the capsule mold to form a *cannabis* puck of the method for packaging *cannabis* shown in FIG. 12.
Figure 16:
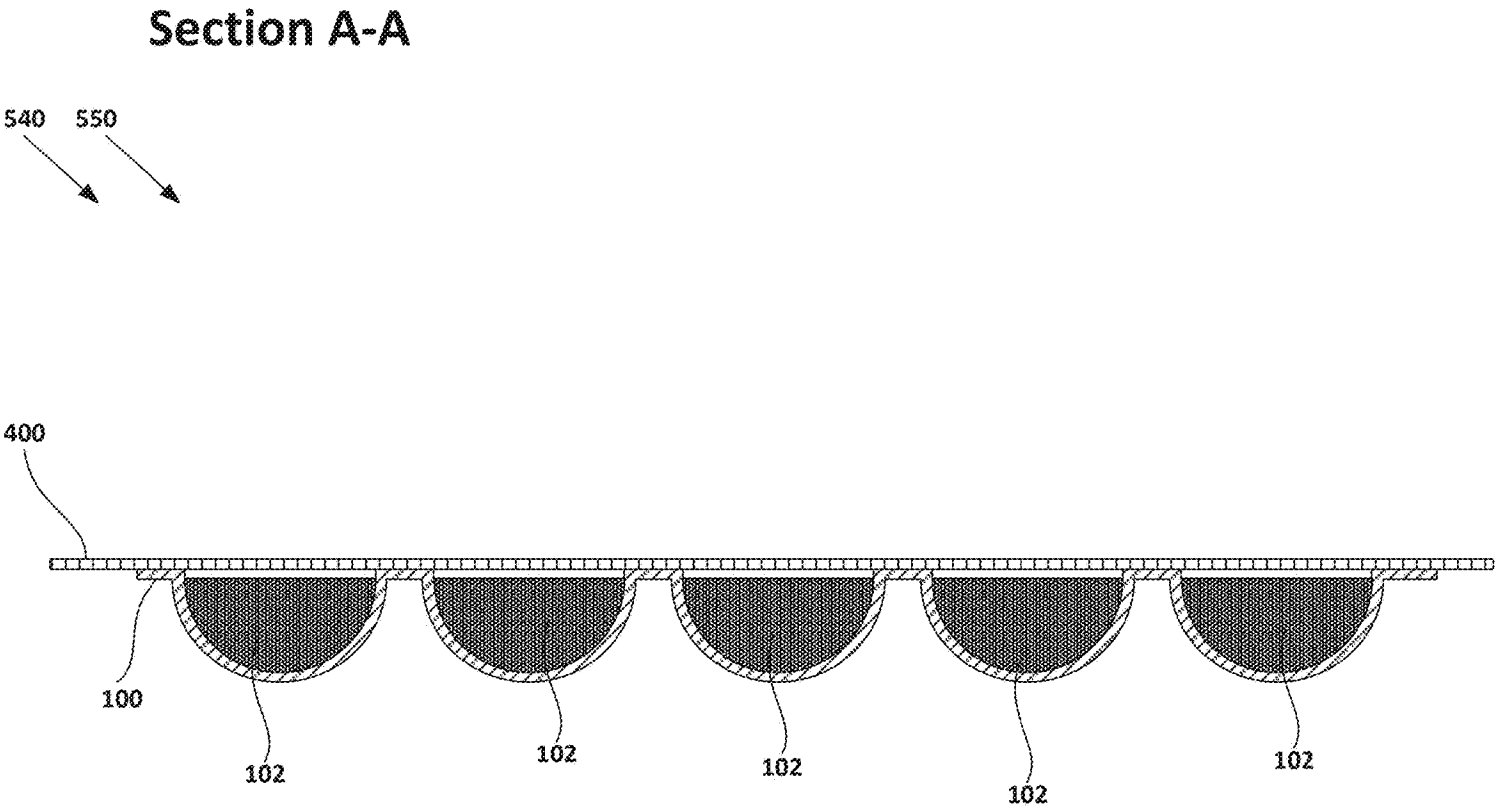
FIG. 16 is a cross-section view of an example of a step of attaching a first cover to the tray to cover the *cannabis* puck in the capsule mold of the method for packaging *cannabis* shown in FIG. 12 taken along plane A-A.
Figure 17:
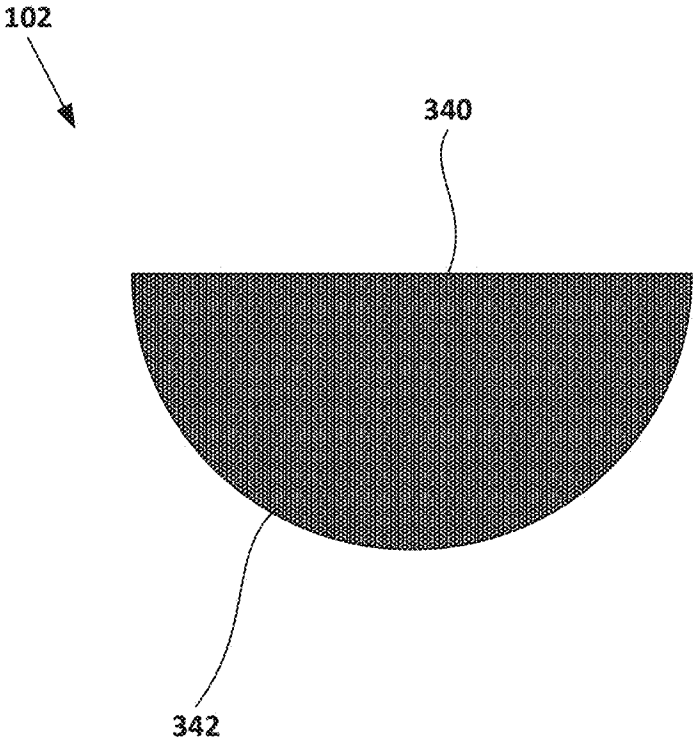
FIG. 17 is a side view of an example of a step of removing the *cannabis* puck from the capsule mold after the conclusion of the method for packaging *cannabis* shown in FIG. 12.

FIG. 12 depicts an example of a method 500 for packaging *cannabis* (e.g., a method for compressing *cannabis*, a method for inhaling *cannabis* smoke, etc.). The method 500 is configured to receive a *cannabis* mixture 200, press the *cannabis* mixture 200 into the *cannabis* puck 102 inside of a package, and cover the *cannabis* puck 102 in the package. In this way, the *cannabis* puck 102 may be supplied to and enable the use of the *cannabis* puck 102 by a user (e.g., smoking *cannabis*, etc.)

The method 500 begins with step 510 which includes mixing (e.g., combining, creating, etc.) the *cannabis* mixture 200. The *cannabis* mixture 200 includes the portion of ground *cannabis* 210 and the binder 220. The binder 220 includes at least one of a portion of *cannabis* resin 222 or a portion of hemp oil 224. In some embodiments, the binder 220 includes both the portion of *cannabis* resin 222 and the portion of hemp oil 224. The step 510 may include mixing a plurality of *cannabis* mixtures 200. In some embodiments, the *cannabis* mixture 200 includes additional ingredients (e.g., loose *cannabis*, preservation agents, etc.).

The method 500 continues with step 520 which includes placing (e.g., setting, filling, etc.) a first of the *cannabis* mixture 200 into a first of the capsule mold 120 of the tray 100. In some embodiments, the method 500 also includes step 522 which includes placing a second of the *cannabis* mixture 200 into a second of the capsule mold 120 in parallel with step 520. In some embodiments, the method 500 includes placing one of a plurality of *cannabis* mixtures 200 into each of the capsule molds 120.

The method 500 continues with step 524 which includes placing (e.g., setting, etc.) the tray 100 onto a supporting mold 350 (e.g., a supporting frame, a stand, etc.). The supporting mold 350 is configured to substantially support and stabilize the tray 100. In some embodiments, the supporting mold 350 may be in confronting relation with the capsule exterior 122 when the tray 100 is placed on the supporting mold 350.

The method 500 continues with step 530 which includes pressing (e.g., compressing, compacting, etc.) the first of the *cannabis* mixture 200 into the first of the capsule mold 120 to form a first of the *cannabis* puck 102. In step 530, the compressive force 300 is applied to the first of the *cannabis* mixture 200 so that the binder 220 binds together the portion of ground *cannabis* 210 inside of the *cannabis* mixture 200. In some embodiments, compressive force 300 travels through the *cannabis* puck 102, through the capsule mold 120, and into a surface. In other embodiments, the compressive force 300 travels through the *cannabis* puck 102, through the capsule mold 120, through the supporting mold 350, and then into the surface.

In some embodiments, the method 500 may also include step 532 which includes applying heat from a heater 332 to the first of the *cannabis* mixture 200 to form the first *cannabis* puck 102. In step 532, heat from the heater 332 is applied to the first of the *cannabis* mixture 200 so that the *cannabis* trichomes in the first of the *cannabis* mixture 200 separate from the ground *cannabis* 210 after the first of the *cannabis* mixture 200 is heated and cause the first of the *cannabis* mixture 200 to bind itself together. Heat may be applied by the controller causing power to be supplied from the power source to the heater 332. In some embodiments, step 532 includes applying heat from a first of the heater 332 of the press 310 to the first of the *cannabis* mixture 200. For example, the first of the heater 332 may be configured to increase the temperature of a first of the press cylinder 330 such that the temperature of the first of the press cylinder 330 is higher than the temperature of the *cannabis* mixture 200. The first of the press cylinder 330 then transfers heat to the *cannabis* mixture 200 such that temperature of the *cannabis* mixture 200 is increased and the *cannabis* trichomes separate from the ground *cannabis* 210. In other embodiments, heat is applied through an alternate means (e.g., increasing a temperature of an environment surrounding the *cannabis* mixture, preheating the *cannabis* mixture 200, etc.). In some embodiments, step 532 and step 530 may be performed simultaneously. In other embodiments, step 530 and step 532 are not performed simultaneously (e.g., heat is applied to the first of the *cannabis* mixture 200 before pressing the first of the *cannabis* mixture 200, heat is applied to the first of the *cannabis* mixture 200 after pressing the first *cannabis* mixture 200, etc.).

In some embodiments, the method 500 also includes step 534 which includes pressing the second of the *cannabis* mixture 200 into the second of the capsule mold 120 to form a second of the *cannabis* puck 102. In some embodiments, step 530 and step 534 are performed simultaneously. In other embodiments, step 530 and step 534 are not performed simultaneously.

In some embodiments, the method 500 also includes step 536 which includes applying heat from a heater to the second of the *cannabis* mixture 200. In step 536, heat from a heater is applied to the second of the *cannabis* mixture 200 so that the *cannabis* trichomes in the second of the *cannabis* mixture 200 separate from the ground *cannabis* 210 after the second of the *cannabis* mixture 200 is heated and cause the second of the *cannabis* mixture 200 to bind itself together. In some embodiments, step 536 includes applying heat from a second of the heater 332 of the press 310 to the second of the *cannabis* mixture 200. In other embodiments, step 536 includes applying heat from the first of the heater 332 of the press 310 to the second of the *cannabis* mixture 200. In some embodiments, step 534 and step 536 may be performed simultaneously. In other embodiments, step 534 and step 536 are nor performed simultaneously.

The method 500 continues with step 540 which includes covering (e.g., enclosing, capping, etc.) the first of the *cannabis* puck 102 inside of the first of the capsule mold 120 with a first of the cover 400. In some embodiments, the method 500 also includes step 542 which includes covering the second of the *cannabis* puck 102 inside of the second of the capsule mold 120 with a second of the cover 400. In other embodiments, the method 500 continues with step 544 which includes covering the first of the *cannabis* puck 102 inside of the first of the capsule mold 120 and covering the second of the *cannabis* puck 102 inside of the second of the capsule mold 120 with a first of the cover 400. In some embodiments, step 540 may be performed in an inert environment (e.g., such that the *cannabis* puck 102 is not exposed to moisture or other contaminants, etc.). In some embodiments, step 540 may be performed in a vacuum (e.g., such that the *cannabis* puck 102 does not oxidize, etc.).

In some embodiments, the method 500 concludes with step 546 which includes adhering (e.g., affixing, gluing, etc.) a first of the cover 400 to the tray 100 using the adhesive 410. In some embodiments, the method 500 also includes step 548 which includes adhering the second of the cover 400 to the tray 100 using the adhesive 410.

After the conclusion of the method 500, a user may grasp (e.g., grab, grip, etc.) a portion of the pull tab 420 (e.g., a string, a strip, etc.) extending from the outside of the cover 400, in some embodiments. The pull tab 420 may be configured to be easier to grab (e.g., has a higher surface friction, can be wrapped around a hand, etc.) than the cover 400.

After the conclusion of the method 500, a user may remove the first of the cover 400 from the tray 100. In some embodiments, the user removes the first of the cover 400 to uncover the first of the *cannabis* puck 102. In some embodiments, the user removes the first of the cover 400 to uncover the first of the *cannabis* puck 102 and the second of the *cannabis* puck 102. In some embodiments, the first of the cover 400 may be re-adhered (e.g., replaced, resealed, etc.) to the tray top 112 using the adhesive 410 after being removed. In other embodiments, the adhesive 410 may no longer be used as an adhesive (e.g., lose its stickiness, etc.) after being removed from the tray 100.

After the user removes the first of the cover 400 from the tray 100, the user may remove the first of the *cannabis* puck 102 from the first of the capsule mold 120. In some embodiments, a user may lift the first of the *cannabis* puck from the first of the capsule mold 120 using a hand of the user. In other embodiments, the user may tip (e.g., angle, rotate, etc.) the tray 100 such that first of the *cannabis* puck 102 falls from the first of the capsule mold 120. In some embodiments, the user may place the first of the *cannabis* puck 102 into a device configured for smoking *cannabis* such that the puck bottom 342 of the first of the *cannabis* puck 102 contacts a bowl of the device. In some embodiments, the device may be a pipe or a bong.

After the user removes the first of the *cannabis* puck 102 from the first of the capsule mold 120, the user may combust (e.g., light, setting on fire, etc.) the puck top 340. The puck top 340 is combusted to transfer the active ingredients of the *cannabis* puck 102 into a smoke (e.g., vapor, gas, etc.) which carries the active ingredients through the air. In some embodiments, the combustion of the puck top 340 may expose additional parts of the *cannabis* puck 102 and allow for the additional parts of the *cannabis* puck 102 to be combusted as well. As a result, all of the *cannabis* puck 102 may be combusted in sequence from the puck top 340 to the puck bottom 342. In some embodiments, the puck top 340 may be combusted with a butane lighter or a match.

After the user combusts the puck top 340, the user may inhale smoke from the combustion of the puck top 340 through the puck bottom 342 of the *cannabis* puck 102. In some embodiments, the *cannabis* puck 102 is located in a bowl of a pipe such that the smoke from the combustion of the puck top 340 travels through the puck bottom 342, through a hole in the bottom of the bowl, and into the pipe where it may be inhaled by a user. In other embodiments, the user may inhale the smoke from the combustion of the puck top 340 through the puck bottom 342 in a different manner (e.g., after traveling through a bong, by allowing the smoke to spread into the atmosphere, etc.).

IV. Configuration of Example Embodiments

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the *cannabis* pack 10 and components thereof as shown in the various exemplary embodiments is illustrative only. Additionally, any element disclosed in one embodiment may be incorporated or utilized with any other embodiment disclosed herein.

What is claimed is:

1. A method for packaging cannabis, the method comprising:

placing a first portion of ground cannabis into a first capsule mold of a tray;

pressing the first portion of ground cannabis into the first capsule mold to form a first cannabis puck;

attaching a first cover to the tray to cover the first cannabis puck in the first capsule mold; and attaching a first pull tab to the first cover, the first pull tab configured to be grasped by a user when the user removes the first cover from covering the first cannabis puck in the first capsule mold.

2. The method of claim 1, further comprising:

placing a second cannabis mixture into a second capsule mold of the tray;

pressing the second cannabis mixture into the second capsule mold of the tray to form a second cannabis puck;

wherein:

the step of attaching the first cover to the tray to cover the first cannabis puck in the first capsule mold further comprises attaching the first cover to the tray to cover the second cannabis puck in the second capsule mold; and the first pull tab is configured to be grasped by the user when the user removes the first cover from covering the second cannabis puck in the second capsule mold.

3. The method of claim 1, wherein the step of attaching the first pull tab to the first cover further comprising orienting the first pull tab such that the first pull tab extends from the first cover.

4. The method of claim 1, wherein the step of attaching the first pull tab to the first cover occurs before the step of attaching the first cover to the tray.

5. The method of claim 1, further comprising:

placing a second cannabis mixture into a second capsule mold of the tray;

pressing the second cannabis mixture into the second capsule mold of the tray to form a second cannabis puck;

attaching a second cover to the tray to cover the second cannabis puck in the second capsule mold; and attaching a second pull tab to the second cover, the second pull tab configured to be grasped by the user when the user removes the second cover from covering the second cannabis puck in the second capsule mold.

6. The method of claim 1, wherein after the method concludes the user grasps the first pull tab to remove the first cover from covering the first cannabis puck in the first capsule mold and removes the first cannabis puck from the first capsule mold.

7. The method of claim 1, further comprising:

applying heat to the first portion of ground cannabis after placing the first portion of ground cannabis into the first capsule mold of the tray, wherein the step of pressing the first portion of ground cannabis into the first capsule mold occurs simultaneously with the step of applying heat to the first portion of ground cannabis.

8. A method for packaging cannabis, the method comprising:

placing a first portion of ground cannabis into a first capsule mold of a tray;

placing a second portion of ground cannabis into a second capsule mold of the tray;

pressing the first portion of ground cannabis into the first capsule mold to form a first cannabis puck;

pressing the second portion of ground cannabis into the second capsule mold to form a second cannabis puck;

attaching a first cover to the tray to cover the first cannabis puck in the first capsule mold; and attaching a second cover to the tray to cover the second cannabis puck in the second capsule mold.

9. The method of claim 8, further comprising:

attaching a first pull tab to the first cover, the first pull tab configured to be grasped by a user when the user removes the first cover from covering the first cannabis puck in the first capsule mold.

10. The method of claim 9, further comprising:

attaching a second pull tab to the second cover, the second pull tab configured to be grasped by the user when the user removes the second cover from covering the second cannabis puck in the second capsule mold.

11. The method of claim 8, wherein the step of attaching the first cover to the tray to cover the first cannabis puck in the first capsule mold further comprises adhering the first cover to the tray to cover the first cannabis puck in the first capsule mold and the step of attaching the second cover to the tray to cover the second cannabis puck in the second capsule mold further comprises adhering the second cover to the tray to cover the second cannabis puck.

12. The method of claim 8, further comprising:

applying heat to the first portion of ground cannabis after placing the first portion of ground cannabis mixture into the first capsule mold of the tray.

13. The method of claim 12, wherein the step of pressing the first portion of ground cannabis into the first capsule mold occurs simultaneously with the step of applying heat to the first portion of ground cannabis.

14. The method of claim 8, wherein the step of pressing the first portion of ground cannabis into the first capsule mold occurs simultaneously with the step of pressing the second portion of ground cannabis into the second capsule mold.

15. A method for packaging cannabis, the method comprising:

placing a first portion of a ground cannabis into a first capsule mold of a tray;

pressing the first portion of the ground cannabis into the first capsule mold of the tray to form a first cannabis puck;

applying heat to the first portion of the ground cannabis after placing the first portion of the ground cannabis into the first capsule mold of the tray, wherein the step of pressing the first portion of the ground cannabis into the first capsule mold occurs simultaneously with the step of applying heat to the first portion of the ground cannabis; and attaching a first cover to the tray to cover the first cannabis puck in the first capsule mold.

16. The method of claim 15, wherein after the method concludes a user removes the first cover from covering the first cannabis puck in the first capsule mold and removes the first cannabis puck from the first capsule mold.

17. The method of claim 16, wherein the user grasps a pull tab coupled to the first cover when the user removes the first cover from covering the first cannabis puck in the first capsule mold.

18. The method of claim 15, further comprising:

placing the tray onto a supporting mold prior to pressing the first portion of ground cannabis into the first capsule mold to form the first cannabis puck.

19. The method of claim 15, further comprising:

placing a second portion of ground cannabis into a second capsule mold of the tray; and pressing the second portion of ground cannabis into the second capsule mold of the tray to form a second cannabis puck;

wherein the step of attaching the first cover to the tray to cover the first cannabis puck in the first capsule mold further comprises attaching the first cover to the tray to cover the second cannabis puck in the second capsule mold.

20. The method of claim 15, further comprising:

placing a second portion of ground cannabis into a second capsule mold of the tray;

pressing the second portion of ground cannabis into the second capsule mold of the tray to form a second cannabis puck; and attaching a second cover to the tray to cover the second cannabis puck in the second capsule mold.

* * * * *